US005287869A

United States Patent [19]

Wu

[11] Patent Number: 5,287,869

[45] Date of Patent: Feb. 22, 1994

[54] CENTER POST OF A COLLAPSIBLE UMBRELLA

[75] Inventor: Jackson Wu, Taipe, Taiwan

[73] Assignee: Fu-Tien Liu, Taiwan

[21] Appl. No.: 103,545

[22] Filed: Aug. 9, 1993

Related U.S. Application Data

[63] Continuation of Ser. No. 995,961, Dec. 23, 1992, abandoned.

[30] Foreign Application Priority Data

Feb. 7, 1992 [CN] China ..... 92 2 02290.9

[51] Int. Cl.[5] ..... A45B 19/00

[52] U.S. Cl. ..... 135/25.1; 135/25.4; 135/40; 403/378; 403/327

[58] Field of Search ..... 135/15.1, 25.1, 25.4, 135/19, 75, 37–40, 19.5, 107, 108, 74; 403/378, 379, 326, 327

[56] References Cited

U.S. PATENT DOCUMENTS

| | | | |
|---|---|---|---|
| 2,649,104 | 8/1953 | Militano | 135/74 |
| 3,904,197 | 9/1975 | Canonge | 403/379 X |
| 3,945,738 | 3/1976 | Bahnsen | 403/378 X |
| 4,099,585 | 7/1978 | Emmerich | 403/378 X |
| 4,858,633 | 9/1989 | Yang . | |
| 4,949,525 | 8/1990 | Weaver | 403/379 X |
| 5,186,197 | 2/1993 | Lavine | 135/25.1 X |

FOREIGN PATENT DOCUMENTS

| | | |
|---|---|---|
| 0527801 | 4/1939 | United Kingdom . |
| 0850340 | 10/1958 | United Kingdom . |
| 0810195 | 3/1959 | United Kingdom . |
| 0826587 | 1/1960 | United Kingdom . |
| 1010213 | 2/1963 | United Kingdom . |
| 1072877 | 10/1964 | United Kingdom . |

*Primary Examiner*—Carl D. Friedman
*Assistant Examiner*—Lan C. Mai
*Attorney, Agent, or Firm*—Ostrolenk, Faber, Gerb & Soffen

[57] ABSTRACT

An improved center post of a collapsible umbrella comprises a retainer body on which two guiding holes are formed to respectively receive therein a first retaining pin biased by a spring and a second retaining pin biased by a spring. The retainer body is inserted into an inner tubular section of the center post to have the retaining pins which are spring-biased to respectively partially project out of two through holes formed on the inner tubular section. The inner tubular section is telescopically received in an outer tubular section of the center post so that when the inner tubular section is in a fully-extended position, the second retaining pin extends through one of the through holes of the inner tubular section to be engaged by a stop piece formed on the outer tubular section and the first retaining pin which extends through the associated one of the through holes penetrates through an opening formed on the outer tubular section to retain the inner tubular section in the fully-extended position in order to open the umbrella. When the umbrella is closed, the runner of the umbrella is slidably moved downward through the opening of the outer tubular section so as to force the first retaining pin inward to allow the inner tubular section to telescopically slide into the outer tubular section.

1 Claim, 4 Drawing Sheets

CENTER POST OF A COLLAPSIBLE UMBRELLA

This is a continuation of application Ser. No. 07/995,961, filed on Dec. 23, 1992, now abandoned.

FIELD OF THE INVENTION

The present invention relates generally to an improved center post of a collapsible umbrella and in particular to the center post structure of which an inner tubular section and an outer tubular section which are telescopically assembled together are easy to manufacture and the engagement thereof is sound and the lengths thereof are short so that when the umbrella is closed, the overall length of the umbrella is short and when the umbrella is open, the center post is extended.

BACKGROUND OF THE INVENTION

Conventional center posts of collapsible umbrellas, which are generally constituted by several tubular sections telescopically received within each other, comprise a holding tab which is controlled by an arcuated spring strip and thus having quite a length. The length of each of the sections which constitutes the center post of the collapsible umbrella will be reduced if the number of the sections is increased and in the case of shorter sections, the long holding tab structure is not suitable to be mounted in a single section of the center post. In another known center post structure, a U-shaped spring strip which has a retaining member mounted on one end thereof comprises a loosening prevention device for retaining the sections of the center post in a desired position. This structure is not only more difficult to manufacture but also provides a poor holding capability thereof. Further, the sections of the center post use outward-projected means to hold the sections in a desired relationship so that if the design of the retaining member is not appropriate, the member may either provide a very poor support to the sections or negatively affect the telescoping movement of the sections and thus making the sections of the center post shaking with respect to each other. Taiwan patent application No. 78202620 provides an improvement to overcome the deficiencies of the above prior art center post structures, as shown in FIGS. 6 and 7. The Taiwan patent application uses a U-shaped spring in the holding tab structure with the tab mounted on one end of the spring to reduce the overall length of the holding tab structure. The Taiwan patent application also uses a U-shaped spring with two retaining members respectively mounted on the two ends thereof which are received in two holes formed on the center post in order to support the center post sections with respect to each other in two opposite sides and thus increasing the holding capability thereof. However, since the retaining members are moved in a swinging manner so that the non-linear motion thereof requires an increase in the size of the holes in which the retaining members are received in order to provide a smooth relative movement therebetween. In that case, there are gaps eft between the retaining members and the holes and thus the sections of the center post are not soundly held together. Further, the U-shaped spring should be manufactured and mounted in a very precise manner which leads in an inconvenience in manufacturing. Besides, the use of a U-shaped spring to bias the two retaining members indicates that the retaining members should be exactly 180 degrees opposite to each other and no other relative angular arrangement is possible. All these reveal that it is desirable to have a center post which is further improved to overcome the problems of the prior art.

SUMMARY OF THE INVENTION

The principal object of the present invention is to provide an improved center post of a collapsible umbrella.

The center post described herein comprises an outer tubular section and an inner tubular section telescopically received in the outer tubular section. The inner tubular section comprises two through holes having central axes not collinear with each other. The inner tubular section has insertedly received therein a retainer body which has two guiding holes thereon in such locations to be collinearly aligned with the through holes. The retainer body comprises a first retaining pin and a second retaining pin respectively slidably disposed within the guiding holes and respectively biased by a first spring and a second spring to partially project out of the through holes of the inner tubular section. The outer tubular section comprises an opening and a stop piece respectively corresponding to the first and the second retaining pins so that when the inner tubular section is fully extended out of the outer tubular section, the second retaining pin is engaged by the stop piece formed on the outer tubular section and the first retaining pin penetrates through the opening formed on the outer tubular section to retain the inner tubular section in the fully extended position.

BRIEF DESCRIPTION OF THE DRAWINGS

The above and other objects and advantages of the present invention will be readily apparent from the following description of preferred embodiments taken in connection with the accompanying drawings, wherein.

DETAILED DESCRIPTION OF THE PREFERRED EMBODIMENTS

Figure 2:
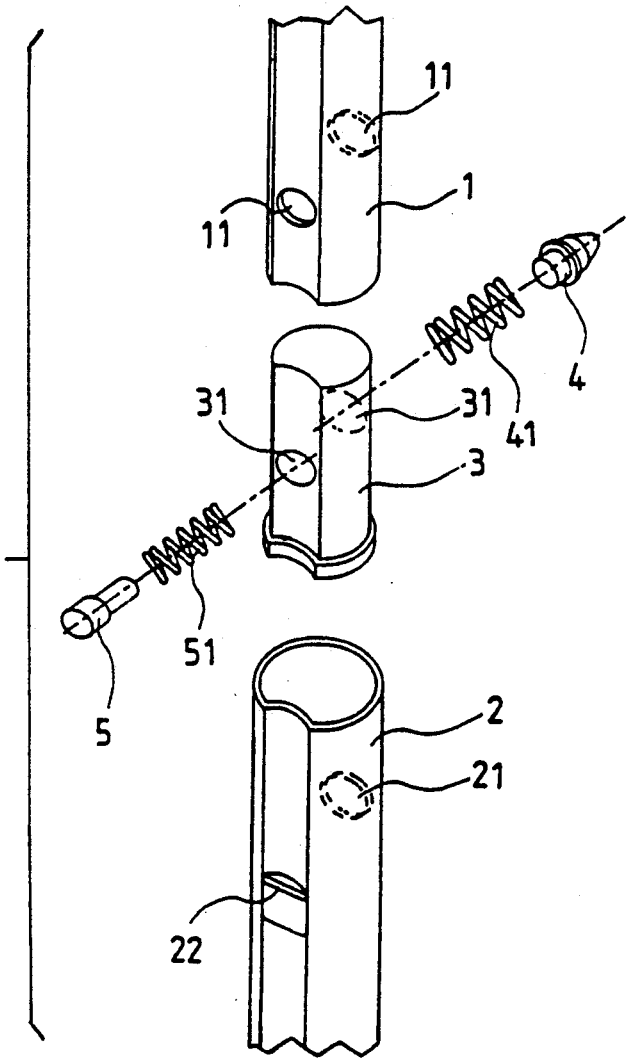
FIG. 2 is an exploded fragmentary view of the center post of the present invention.
Figure 1:
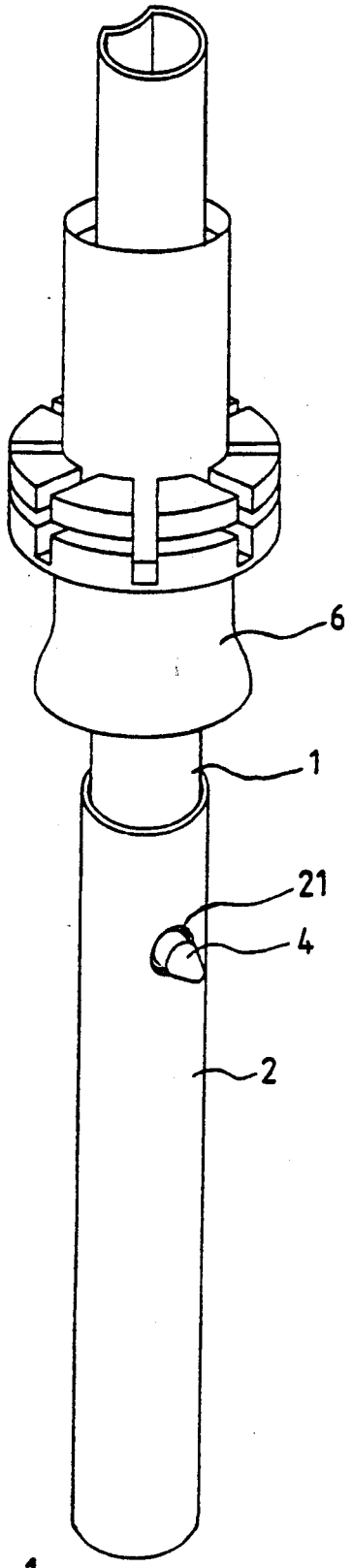
FIG. 1 is a perspective view of a center post of a collapsible umbrella in accordance with the present invention.
Figure 3:
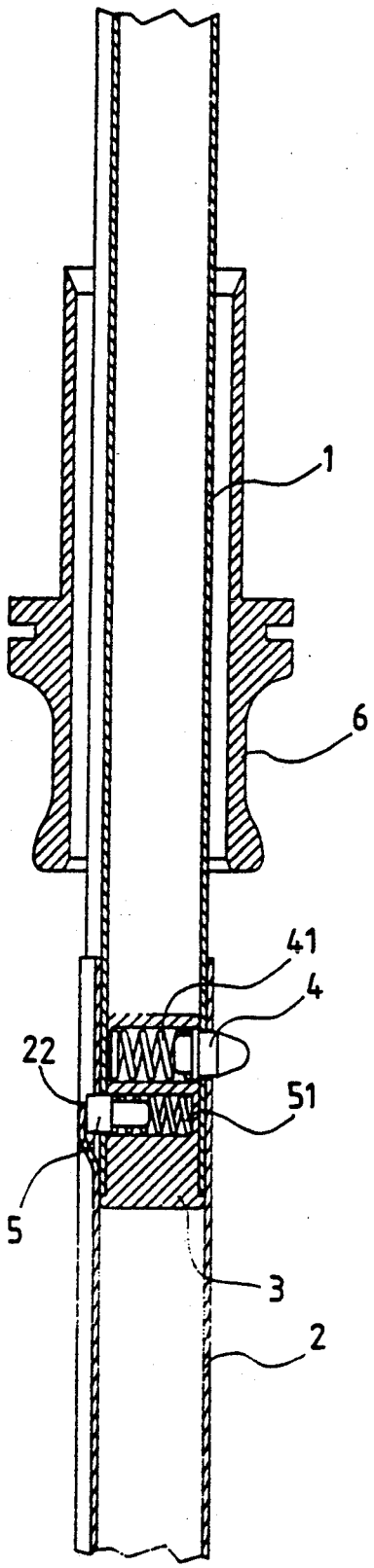
FIG. 3 is a cross-sectional view showing the center post in a fully-extended position, thus opening the umbrella.
Figure 4:
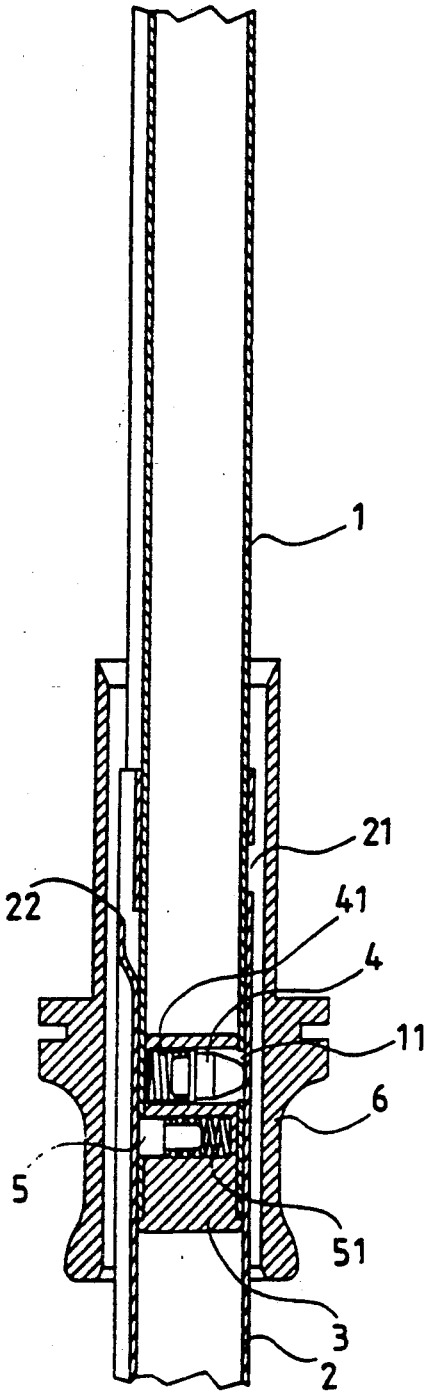
FIG. 4 is a cross-sectional view showing the center post in a retracted position, thus closing the umbrella.
Figure 5:
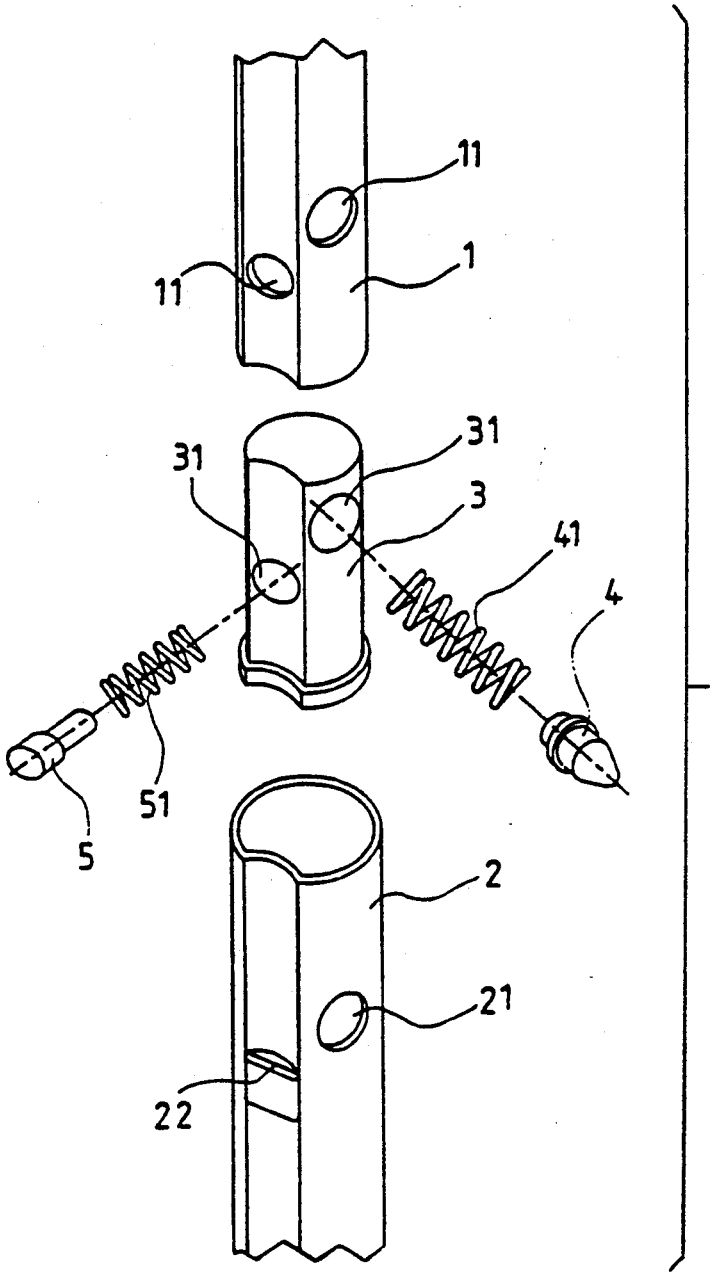
FIG. 5 is an exploded fragmentary view showing another embodiment of the collapsible umbrella center post structure.
Figure 6:
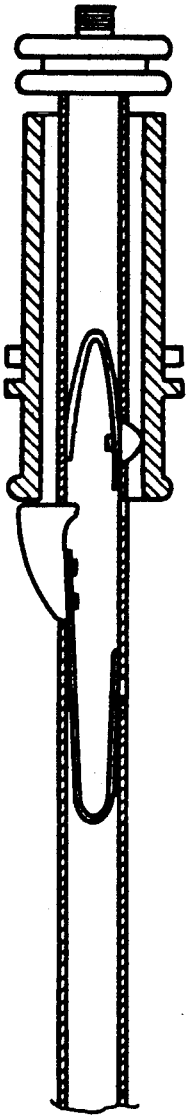
FIG.6 PRIOR ART
FIGS. 6 and 7 show the structures of two prior art center posts of collapsible umbrellas.
Figure 7:
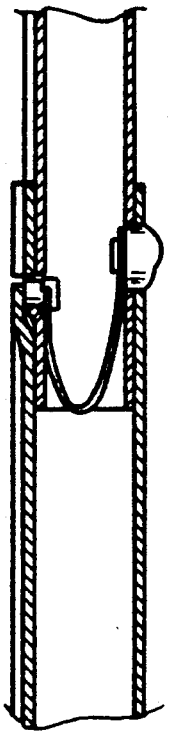
FIG.7 PRIOR ART

With reference to FIGS. 1–4, a collapsible umbrella center post of the present invention is shown to be constituted generally by several tubular sections telescoping within each other comprising an inner tubular section 1 and an outer tubular section 2 with retaining means disposed therebetween. As shown in FIG. 2, two through holes 11 are formed on the inner tubular section 1 with the central axes thereof not collinear with each other. A retainer body 3 having a cross-sectional shape complemental to the inner cross section of the inner tube 1 is inserted therein. On the retainer body 3, two guiding holes 31 are formed so that when the retainer body 3 is inserted into the inner tubular section 1, the two guiding holes 31 are respectively collinearly aligned with the through holes 11 of the inner tubular section 1. Within the guiding holes 31, a first retaining pin 4 and a second retaining pin 5 are respectively disposed and are biased by a first spring 41 and a second spring 51 to partially project out of the guiding holes 31. The inner tubular section 1 with the retainer body 3 therein, as well as the biasing springs 41 and 51 and the retaining pins 4 and 5, is then telescopically inserted into the outer tubular section 2 to complete the assembly of the instant collapsible umbrella center post. On the outer tubular section 2, an opening 21 and a stop piece 22 which is formed by pressing a portion of the outer tube 2 are formed, respectively corresponding to the positions of the first retaining pin 4 and the second retaining pin 5 so that when the instant center post is in a fully-extended position (as shown in FIG. 3), the first retaining pin 4 and the second retaining pin 5 respectively extend into the opening 21 and the stop piece 22. The linear movements of the retaining pins 4 and 5 in and out of the through holes 11, together with the more precise engagement thereof with the opening 21 and the stop piece 22 of the outer tubular member, provide a more sound support of the inner tubular section 1 in the fully-extended position than the prior art center posts. When the umbrella is opened, the center post is fully extended and thus the second retaining pin 5 extends out of the corresponding one of the through holes 11 to be engaged by the stop piece 22 and meanwhile, the first retaining pin 4 which penetrates through the corresponding through hole 11 extends out of the opening 21 of the outer tubular section 2 so as to form the fully-extended center post. When the umbrella is closed, a runner 6 which is slidably mounted on the center post is moved down along the center post and then the retaining pins 4 and 5 are forced inward to allow the inner tubular section 1 to telescope into the outer tubular section 2 (as shown in FIG. 4). An advantage of the instant center post structure is that the retaining pins 4 and 5 and thus the through holes 11 of the inner tubular section 1 and the opening 21 and stop piece 22 of the outer tubular section 2 can be disposed at any locations and directed along any orientations as desired, provided that the stop piece 22 is located on a guiding slot which extends along each of the sections 1 and 2 to guide the relative vertical movement between the sections 1 and 2 and to prevent the relative rotation between the sections 1 and 2 and the second retaining pin 5 ;s thus directed toward the guiding slot, such as the second embodiment shown in FIG. 5 in which the two retaining pins 4 and 5 are extending along substantially mutually perpendicular directions. Since the disposition of the vertical guiding slot is well known to those skilled in the art, no detail thereof is needed herein.

From the above description, it can be understood that the present invention has overcome the deficiencies of the prior art collapsible umbrella center posts and does provide a sound engagement between the sections of the center post and a ready and easy manufacturing design of the center post.

It is apparent that although he invention has been described in connection with the preferred embodiments, it is contemplated that those skilled in the art may make changes to certain features of the preferred embodiment without altering the basic concept of the invention and without departing from the spirit and scope of the invention as defined in the appended claims.

What is claimed is:

1. A center post of a collapsible umbrella comprising an outer tubular section and an inner tubular section telescopically received in said outer tubular section wherein the improvements comprises that: said inner tubular section comprises two through holes having central axes not collinear with each other, said inner tubular receiving therein a retainer body which has two guiding holes in such locations to be collinearly aligned with said through holes, said retainer body comprising a first retaining pin and a second retaining pin respectively slidably disposed within said guiding holes and respectively biased by a first spring means and a second spring means to partially project out of said through holes of the inner tubular section, said outer tubular section comprising an opening and a stop piece respectively corresponding to said retaining pins so that when said inner tubular section is fully extended out of said outer tubular section, said second retaining pin is engaged by said stop piece formed on said outer tubular section and said first retaining pin penetrates through said opening formed on said outer tubular section to retain the inner tubular section in the fully-extended position.

* * * * *